US005181965A

United States Patent [19]

Bakanowsky, III

[11] Patent Number: 5,181,965

[45] Date of Patent: Jan. 26, 1993

[54] METHOD OF CLEANING ELECTRICAL CONTACTS FOR COMPUTER AND VIDEO GAMES

[75] Inventor: Louis J. Bakanowsky, III, Fitchburg, Mass.

[73] Assignee: Curtis Manufacturing Company, Inc., Jaffrey, N.H.

[21] Appl. No.: 882,071

[22] Filed: May 12, 1992

Related U.S. Application Data

[62] Division of Ser. No. 721,163, Jun. 26, 1991.

[51] Int. Cl.[5] ..... B08B 1/00

[52] U.S. Cl. ..... 134/8; 15/104.94; 15/210.1; 51/281 R; 134/6; 134/22.1

[58] Field of Search ..... 15/104.92, 104.93, 104.94, 15/210 R, 118; 51/57, 59 R, 205 R, 205 WG, 281 R; 134/6, 8, 22.1

[56] References Cited

U.S. PATENT DOCUMENTS 3,807,010 4/1974 Semrad ..... 15/210 R
3,956,789 5/1976 Shults ..... 51/51 R
4,951,425 8/1990 Naghi ..... 15/210 R
4,993,100 2/1991 Halboth ..... 15/210 R
5,025,526 6/1991 Ichitsubo ..... 15/210 R

*Primary Examiner*—Bruce M. Kisliuk
*Assistant Examiner*—Jack Lavinder
*Attorney, Agent, or Firm*—Richard P. Crowley

[57] ABSTRACT

A cleaning cartridge and method for cleaning the electrical contacts of a connector block of a computer or video game having a cartridge receptacle and wherein the cleaning cartridge has a housing to be inserted into the cartridge receptacle and the housing contains a board having a one and the other end, the other end of the board having on at least one planar surface a cleaning material adapted to clean the electrical contacts of a connector bar, the other end extending outwardly of the housing, and wherein the board is adapted to move in a slidable manner between by the user grasping the other end of the board between an outwardly extending, non-cleaning position and inwardly extending, cleaning position.

5 Claims, 2 Drawing Sheets

METHOD OF CLEANING ELECTRICAL CONTACTS FOR COMPUTER AND VIDEO GAMES

This is a divisional of copending application Ser. No. 07/721,163 filed on Jun. 26, 1991.

SUMMARY OF THE INVENTION

Computers, such as personal computers, and a wide variety of video game systems, such as the NINTENDO® game system and the hand-held, portable GAME BOY® system (GAME BOY and NINTENDO are registered trademarks of Nintendo of America, Inc.) are adapted to receive computer and video game cartridges within a program cartridge receptacle. Generally, the cartridge comprises a printed circuit board enclosed within a housing, the housing adapted to fit within the cartridge receptacle. For example, in the NINTENDO® video game system, the typically cartridge is inserted within the cartridge receptacle and then pushed downwardly by the user to lock the cartridge in place, and then cartridge after use is released by downward pressure to spring into an upward position, while in the portable GAME BOY® the cartridge may merely just be inserted within the cartridge receptacle. The printed circuit boards of the cartridges employed are electrically connected to the electronic system of a computer or video game system when the cartridge is inserted in the cartridge receptacle.

The electrical contacts within the computer or video game systems often acquire dust, dirt, oils and oxidation and other debris detrimental to the efficient operation of the electrical contacts from the frequent use of the cartridges into the cartridge receptacle. Such debris adversely effects the electrical surface performance of the computer or video game system, so that the efficient and frequent cleaning of the electrical contacts is a desirable procedure.

Generally, the employment of alcohol or other solvents via swab-type methods or by the employment of hand-held cleaning, polishing or burnishing tools is awkward and not easily accomplished by users.

A computer and video game cleaning cartridge has been disclosed in U.S. Pat. No. 4,951,425, issued Aug. 28, 1990 in which a cleaning cartridge is inserted into a receptacle and burnishing material at one end of a planar board provides for the cleaning of the electrical contacts of the connector block when the cartridge is inserted in place. Such a cleaning cartridge requires replacement of the entire cartridge when the burnishing material on the board has been used or deteriorated, and further, such cleaning cartridge immediately places the burnished materials into a cleaning position upon insertion of the cartridge into the cartridge receptacle.

It is desirable to provide for a new, inexpensive, flexible cleaning cartridge and method in which the cleaning cartridge in the cartridge receptacle may be placed in a non-cleaning or cleaning position by the user and by which the boards containing the polishing, cleaning or burnishing materials may be easily and readily replaced by the user without replacement of the entire cartridge and to provide other advantages.

SUMMARY OF THE INVENTION

The present invention is directed to a cleaning cartridge for computer and video games and to a method of cleaning electrical contacts of a connector block within the cartridge receptacle of a computer or video game system.

In one embodiment, there is described a cleaning cartridge for cleaning electrical contacts of connector blocks within a person computer or video game system with a receptacle, such a NINTENDO® game system or portable GAME BOY® system, and wherein the cleaning cartridge can be inserted into said computer receptacle and then at the option of the user placed in a cleaning or non-cleaning position by movement of the cleaning, polishing or burnishing material between a cleaning and non-cleaning position.

In particular, the cleaning cartridge of the invention comprises a housing typically composed of a top and bottom section the housing adapted to be inserted within the cartridge receptacle of the particular personal computer or video game system in which it is to be employed. The housing contains a board generally having a one and the other end and positioned within the housing with the one end generally extending outwardly from the housing, so it may be grasped by the user, and the other end having at least one planar surface and typically two planar opposing surfaces and an edge containing a cleaning material. More particularly, the cleaning material may comprise a polishing, burnishing or abrasive-type material or a solvent-saturated fiber or foam, so that such cleaning material is adapted to be placed in contact with the electrical contacts to clean said electrical contacts in the cleaning position. The board within the housing is provided with means for the slidable planar movement of the board between an outwardly extending, non-cleaning position and an inwardly extending, cleaning position. The board is supported within the housing and generally slidably moves on tracks within grooves, so that it may be easily slid in a planar manner between the cleaning and non-cleaning positions by the user grasping and moving the outwardly extending other one end of the board.

The housing may be typically composed of a top and bottom half sections, which sections are hinged together on one side and with a clasp or locking means on the other side to permit the hinged movement of the top and bottom sections between a closed position wherein the cleaning cartridge is inserted into said cartridge receptacle, and an open position, whereby the user may insert a new board containing new polishing materials as desired. The board optionally includes toward the other end just prior to the cleaning material on the planar surface of the board a stop means, such as a short, raised transversely extending rib on the upper and lower surfaces of the board to control the depth of insertion of the planar surface containing the cleaning material within the electrical contacts.

The board may comprise a planar board, for example when employed with the small size cartridges employed in a GAME BOY® video game system or for example may comprise a non-planar configuration wherein a portion of the planar surfaces of the board within the housing is on a slightly different plane than the planar surface of the board that extends from the one end which arrangement is particularly useful for instance in connection with the NINTENDO® video game systems wherein the cleaning cartridge, after insertion of the cartridge receptacle, must be pushed downwardly into a position for effective cleaning of the electrical contacts thus permitting the one end of the board on another plane to extend outwardly from the cartridge receptacle.

The movement of the board between a cleaning and non-cleaning permits the user to control when the cleaning cartridge is in a cleaning mode. The hinged or open housing permits access into the interior of the housing for easy replacement of the cleaning board and permits new cleaning boards to be inserted as desired without the need for replacing the entire cartridge.

The board may be provided for movements in the same or different plane by the user's movement of the board. The slidable, lateral movement of the board between the cleaning and non-cleaning positions may be accomplished by a variety of techniques. In one embodiment, a plurality of parallel, elongated grooves framed by spaced apart ribs and a plurality of matching elongated tracks to fit within the grooves are used. The grooves and the tracks may be on the surface of the planar board and typically with supporting lower ribs to maintain the planar board in a desired position within the housing and thereby to permit the slidable movement of the board within the grooves between the cleaning and non-cleaning positions. For example, the grooves and the matching tracks may be placed either on the top or bottom section or on the top or bottom planar surface of the board. Generally, the top and bottom housing and the board are composed of a lightweight, molded, thermosetting-type plastic such as acrylic nitrile or molding resin which permits easy sliding movement of the board between the cleaning and non-cleaning positions.

The invention also includes a method of cleaning the electrical contacts of a connector block within a cartridge receptacle of a computer, such as a personal computer, or a cartridge-type video game system, which method comprises inserting a cleaning cartridge into the said cartridge receptacle, the cleaning cartridge containing a cleaning means, such as a cleaning board, having a one and the other end, and one end of the board, or some extension thereon, extending outwardly from the cartridge receptacle with the cleaning cartridge in place and the other end having an electrical contact cleaning material on at least one planar and generally two planar surfaces at the other end thereof adapted to be placed in an electrical contact cleaning position; and slidably moving the board by the user within the housing between an outward, non-cleaning position and an inward, electrical contact cleaning position. The method also includes opening the housing of the cleaning cartridge in order to permit the insertion of a new cleaning means containing new or different cleaning material when the need arises, and also providing tracks and grooves within the housing so that the cartridge may move through the track and matching groove system between the respective positions longitudinally of the cartridge.

The invention shall be described for the purposes of illustration only in connection with certain embodiments; however, it is recognized that those persons skilled in the art may make various changes, modifications, additions and improvements to the illustrated embodiments, without departing from the spirit and scope of the invention.

DESCRIPTION OF THE EMBODIMENTS

Figure 1:
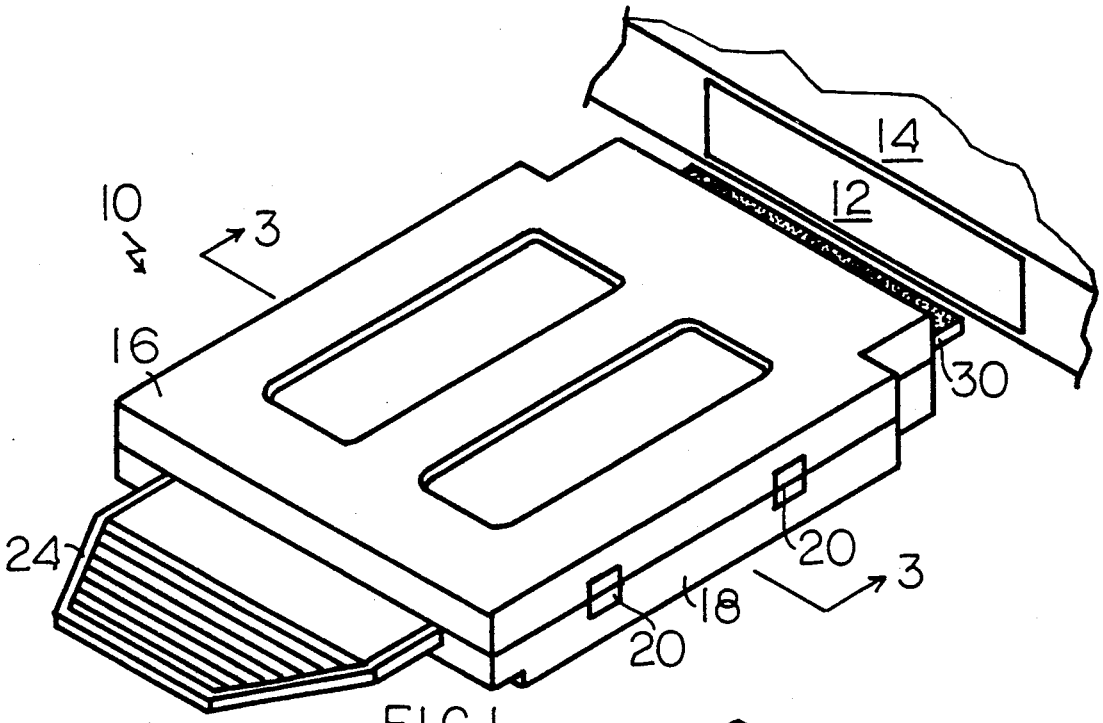
FIG. 1 is a perspective view from above of the cleaning cartridge of the invention showing the cleaning cartridge positioned for insertion into a cartridge receptacle of a NINTENDO® game system.
Figure 2:
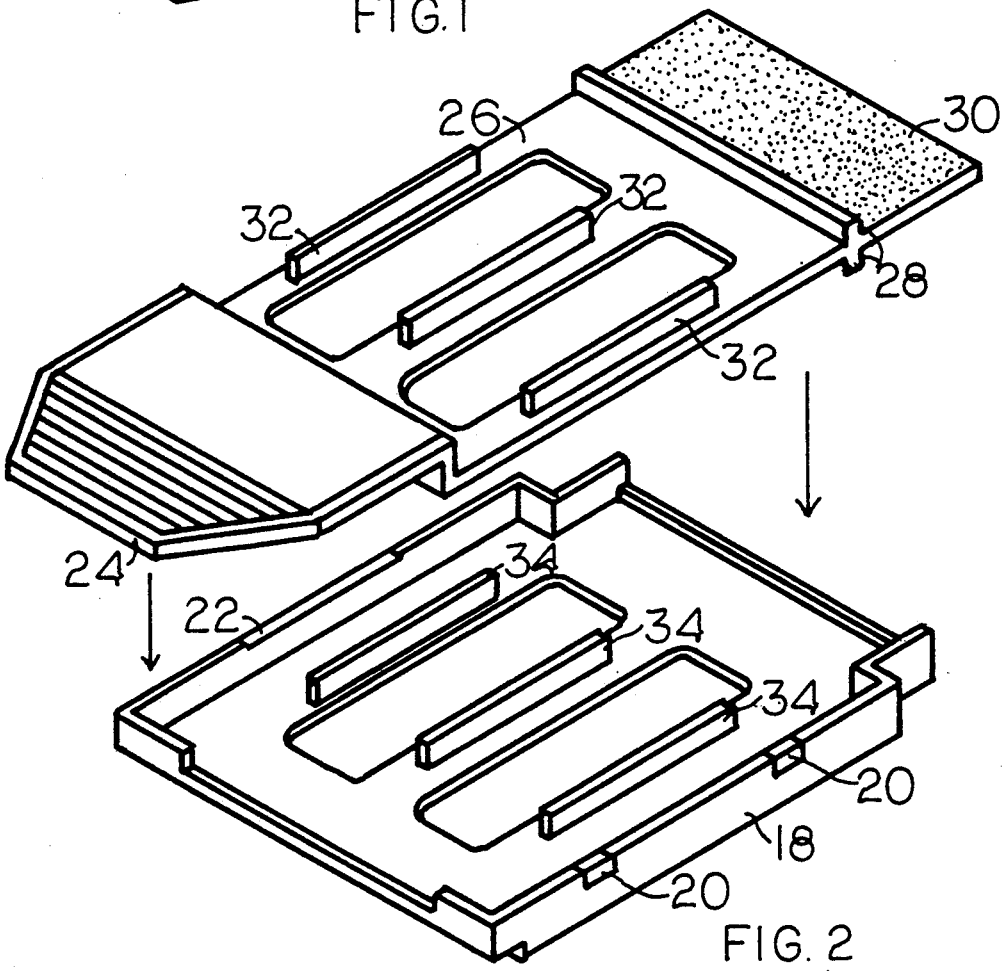
FIG. 2 is an exploded view of a portion of the cleaning cartridge of the invention.
Figure 3:
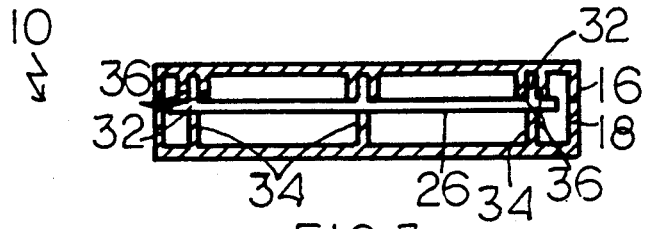
FIG. 3 is a sectional view along lines 3—3 of FIG. 1 of the cleaning cartridge.
Figure 5:
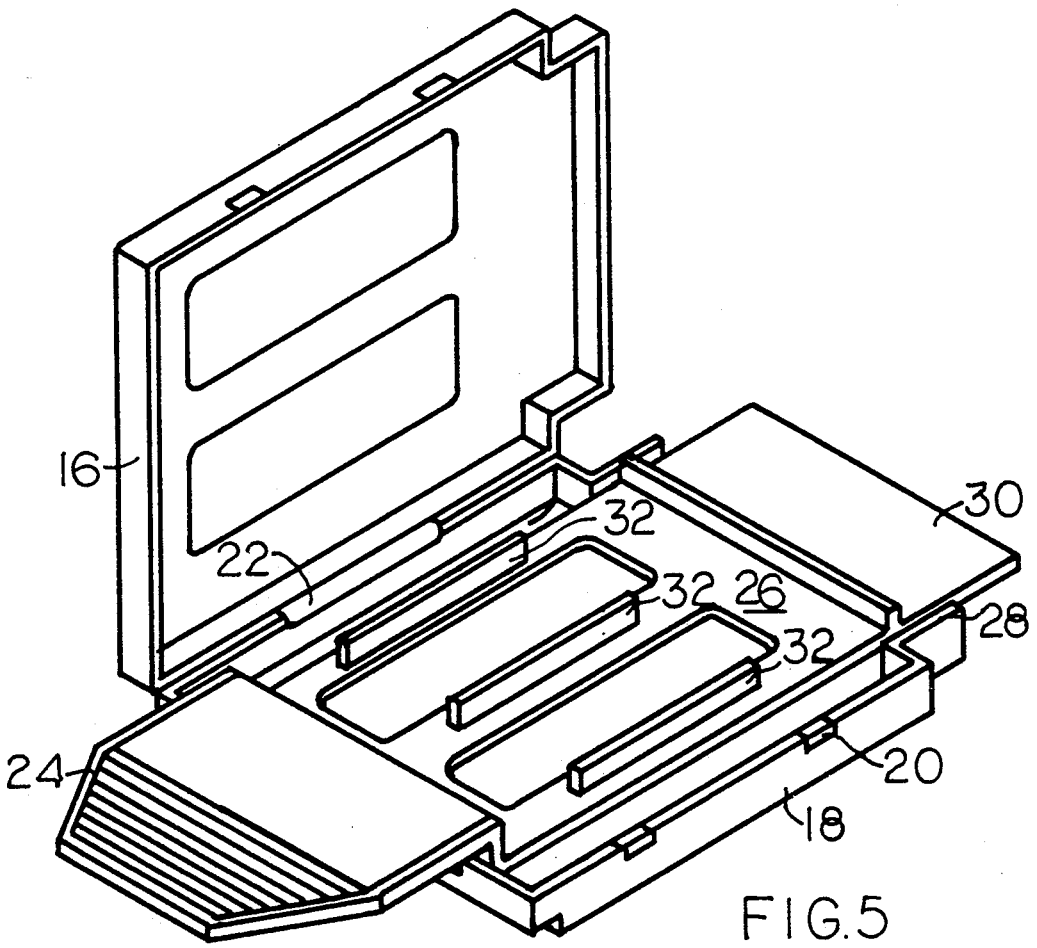
FIG. 5 is a perspective view from above of the cleaning cartridge of the invention in an open position.

With reference to the drawings, there is shown a cleaning cartridge 10 of the invention, the cartridge adapted to be inserted within the cartridge receptacle 12 as illustrated of a NINTENDO® video game system 14. The cleaning cartridge comprises a housing composed of a top half section 16 and a bottom half section 18, the top and bottom sections 16 and 18 secured together by plastic living hinges 20 on one side and a locking clasp 22 on the other side so that the top and bottom sections 16 and 18 may move between a latched, closed position as illustrated in FIG. 1 and an open position as illustrated in FIG. 5 whereby the cleaning board within the housing may be replaced.

The housing includes within the housing a planar cleaning board 26 having a serrated friction surface handle 24 at the one end of the board of grasping by the user and which handle extends outwardly from the cleaning cartridge. The one end is adapted to extend outwardly from the cartridge receptacle, so it may be grasped and used by the user in moving the board 26 between the cleaning and non-cleaning positions. The planar board 26 includes toward the other end at a defined position a generally perpendicular stop 28 extending a short distance from the bottom and top surfaces of the board 26. At the other end of the board 26 on both opposite planar surfaces of the board and about the adjoining edge, there is disposed a cleaning material, typically a layer of polishing, burnishing or abrading material composed of an aluminum oxide or other finely divided, particulate matter embedded in a binder and which may comprise a fine sand paper-type material secured for example by adhesives to the planar surface of the board and extending around the other edge and to the lower surface as a cleaning material 30. The nature of the cleaning material 30 may vary as desired in the nature of the material adapted to provide for a cleaning, polishing, burnishing, abrading or other action to remove debris related to the electrical contacts of the connector board within the cartridge receptacle.

In the illustrated embodiment, the board 26 contains three generally parallel, slightly raised tracks 32 on the upper surface of the board 26, which tracks 32 are adapted to fit into three matching grooves 36 defined by spaced apart ribs on the top section 16 of the housing, while the board 26 is placed on a plurality of three support ribs 34 secured on the bottom section providing a surface for the slidable movement of the board. The arrangement of the tracks, grooves and supporting ribs of course may be changed as desired, provided that the board is slidably or otherwise movable between the cleaning and non-cleaning positions within the top 16 and bottom 18 sections which comprise the housing of the cleaning cartridge 10.

Figure 4A:
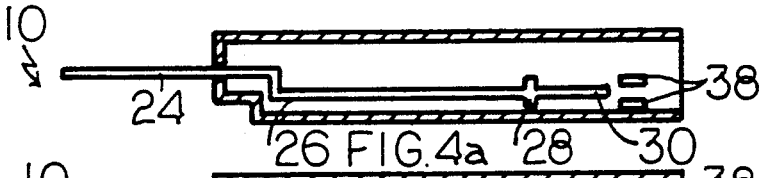
FIGS. 4*a* and 4*b* are schematic, illustrated, longitudinal sectional views of the cleaning cartridge in a non-cleaning position (4*a*) and in a cleaning position (4*b*).
Figure 4B:
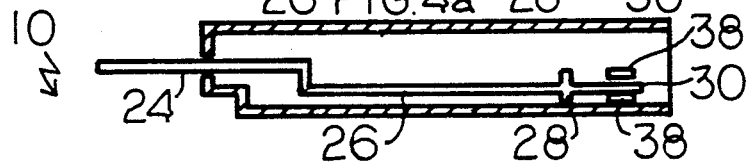

With reference to FIG. 4 as illustrated in a schematic illustration, the position of the board 26 both in the non-cleaning position (4*a*) wherein the area of cleaning material on each side of the other end of the board 26 is positioned apart from the electrical contacts 38, and FIG. 4*b* in the cleaning position by slidable movement of the board forward with the cleaning material 30 is placed within and into contact with the electrical contacts 38. Movement of the board 26 between the non-cleaning and cleaning position is carried out by the user merely grasping the one end of the board handle 24, moving board backwards and forwards as desired.

In the illustrated embodiment, the board 26 comprises two separately planar sections connected with a short, right angle bend, which board is designed for example for use with the NINTENDO® game system. However, it is recognized that the board 26 may comprise a straight planar board without the need of different planar sections, for example, with the portable GAME BOY® video game section where smaller cartridges are employed and direct insertion is used then with the NINTENDO® video game system.

As illustrated in FIG. 5, the cleaning cartridge 10 of the invention provides for easy replacement of the cleaning board 26 by merely opening the housing and replacing the board 26, and then closing the sections 16 and 18. The cleaning cartridge 10 may be sold with one or more replaceable boards 26 containing cleaning material 30. The cleaning cartridge 10 further permits the opening of the housing of the cleaning cartridge between an open and closed position.

The cleaning cartridge 10 of the invention thus provides an efficient, inexpensive cleaning system wherein the user controls the cleaning action, and the cleaning materials can be easily replaced by the user.

What is claimed is:

1. A method of cleaning electrical contacts within a computer or video game cartridge receptacle, which method comprises:

a) inserting a cleaning cartridge into a cartridge receptacle, the cleaning cartridge containing a board with a one and another end, one end extending outwardly from the cartridge, and the other end having a cleaning material on one or both planar surfaces thereof; and b) slidably moving the board relative to the cartridge by a user grasping the one end of the board between an outwardly extending, non-cleaning position and an inwardly extending, cleaning position to clean the said electrical contacts.

2. The method of claim 1 which includes providing a housing for the board, which housing is adapted to move between an open and a closed position, and in the open position to provide for the insertion of a new board for cleaning purposes and in the closed position adapted to be inserted in the cartridge receptacle in use.

3. The method of claim 1 which includes placing a plurality of spaced apart generally parallel raised elements on at least one surface of the board for slidable movement of the elements on and adjacent to spaced apart, generally parallel, raised support ribs in the cleaning cartridge.

4. The method of claim 1 which includes controlling the position of the board within the cleaning cartridge between the defined cleaning and non-cleaning positions.

5. The method of claim 1 which includes placing a layer of cleaning material secured by an adhesive on both planar surfaces at the other end of the board.

* * * * *